US005908262A

United States Patent [19]

Ahn

[11] Patent Number: 5,908,262

[45] **Date of Patent: *Jun. 1, 1999**

[54] SELF-RECOVERING, BASALLY ADHERED TRAFFIC LANE DELINEATOR

[76] Inventor: Eui Sig Ahn, Bokgee Apt. 1-402, Kweian-Dong, Sosa-Gu, Buchun-Si, Kyungki-Do, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 08/782,209

[22] Filed: Jan. 15, 1997

[30] Foreign Application Priority Data

Apr. 20, 1996 [KR] Rep. of Korea ..... 1996-12094

[51] Int. Cl.[6] ..... E01F 9/017

[52] U.S. Cl. ..... 404/9; 404/10; 116/63 P

[58] Field of Search ..... 116/63 P, 63 C; 404/9, 10, 11, 13, 14, 16; 40/607, 608

[56] References Cited

U.S. PATENT DOCUMENTS

| | | | |
|---|---|---|---|
| 1,668,486 | 5/1928 | Betts | 404/9 X |
| 3,913,518 | 10/1975 | Kaplan | 116/63 P X |
| 4,269,534 | 5/1981 | Ryan | 404/10 |
| 4,569,495 | 2/1986 | Woudenberg et al. | 404/10 X |
| 4,806,046 | 2/1989 | Clark . | |
| 5,199,814 | 4/1993 | Clark et al. . | |
| 5,205,236 | 4/1993 | Hughes | 116/63 R |
| 5,305,538 | 4/1994 | Kanzelberger | 40/616 |
| 5,515,807 | 5/1996 | Speer et al. | 404/16 X |
| 5,587,699 | 12/1996 | Faloon et al. | 340/475 |

FOREIGN PATENT DOCUMENTS

| | | | |
|---|---|---|---|
| 4243241 | 6/1994 | Germany | 404/9 |
| 2207943 | 2/1989 | United Kingdom | 116/63 C |

*Primary Examiner*—James A. Lisehora
*Attorney, Agent, or Firm*—Pillsbury Madison & Sutro LLP

[57] ABSTRACT

A basally adhered, self-recovering traffic lane delineator has a cylindrical post made of flexible material, having the air outlet and inlet on the center of its upper surface, and a supplementary support panel placed and adhered underneath the post. The support panel supports a lower part of the post and is adhered on the ground. Owing to its small package volume, the delineator is easy to move and safeguard.

3 Claims, 5 Drawing Sheets

SELF-RECOVERING, BASALLY ADHERED TRAFFIC LANE DELINEATOR

BACKGROUND OF THE INVENTION

This invention relates to the traffic delineator, in particular, a traffic lane delineator which is adhered at its base to the pavement, and is arranged to self-recover to an upright position, so as to be more effective for drawing the attention of drivers, thereby improving safety. The delineator is so built as to get squeezed when impacted and to recover it's own shape after lapse of impact, so that it's product life span is fully extended and the vehicle collided therewith is substantially unharmful from the impact.

Generally, a delineator that is normally made of metal pipe or P.V.C. pipe and has a reflection sheet is attached thereon has been used for the purpose of drawing the attention of drivers and having the drivers recognize the traffic lanes more accurately, specially at an airport, on a road or in a parking place, thus guaranteeing safety driving.

However, having been made of solid material such as metal or P.V.C. pipe and the like as above describes, the conventional delineator is not only easily broken upon even slight impact, but also the vehicle collided therewith may be damaged, as well as personal injury occur.

For the reasons above stated, the coventional delineator must be exchanged from time to time and therefore significant economic losses have been experienced.

Further, when installing the conventional delineator, since the post and support panel and supplemental support panel are formed in one body, the installation work that is absolutely needed to place the bottom part of the post on the ground with no gap and then bolt it in position is very much troublesome. Furthermore, for the same reason as above stated, it occupies the broad space so that safeguarding and moving it is difficult.

SUMMARY OF THE INVENTION

This invention is designed to overcome the above-noted problems that the conventional delineator has. Accordingly the object of this invention is as follows.

An object of this invention is to provide a surface adhesive mounted and self recovering delineator made of the flexible materials so as to recover its own shape for itself after impacts, by which the both personal injury and delineator injury can be prevented.

Another object of this invention is to provide a surface adhesive mounted and self-recovering delineator with which a collided vehicle is also kept unharmed even when impacted.

Still another object of this invention is to provide a surface adhesive mounted and self-recovering delineator having a post which is separates from a supporter panel so that moving and safeguarding it is very easy.

A further object of this invention is to provide a surface-adhesive mounted and self-recovering delineator of which installation work can be simply completed, thus the work efficiency being extremely enhanced.

DETAILED DESCRIPTION OF THE PREFERRED EMBODIMENT OF THE INVENTION

In order to attain the above goals, the delineator includes a post made of flexible materials in a cylinderical form, having an air inlet and an air outlet on its upper surface a, supplementary support panel joined with a lower part of the post and the support panel jointed with below part of said post having the supplememtary support panel and being adhered on the ground.

As the delineator constructed as above, the preferred embodiment of this invention is described in more detail below, with reference to the accompanying drawings.

Figure 2:
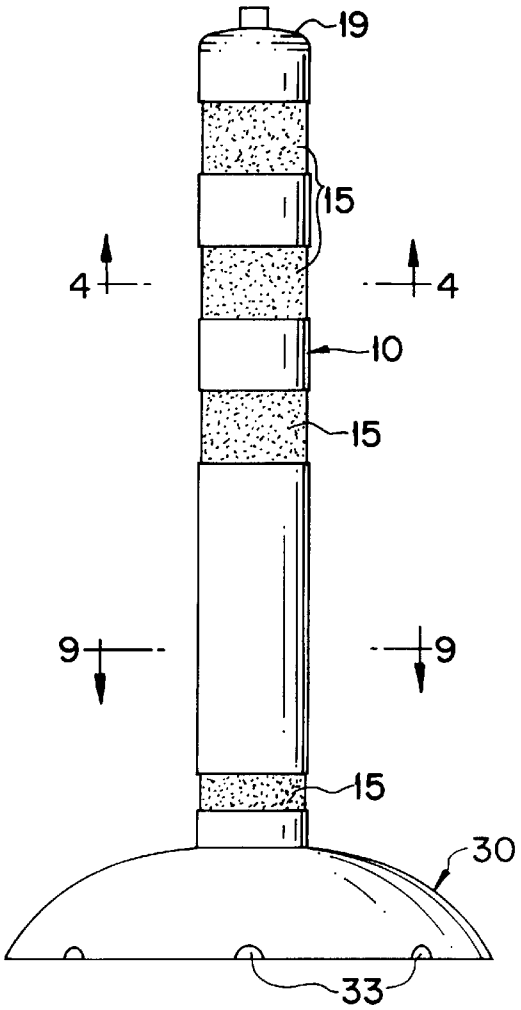
FIG. 2 is a front view of the surface adhesive mounted and self-recovering delineator of this invention.
Figure 1:
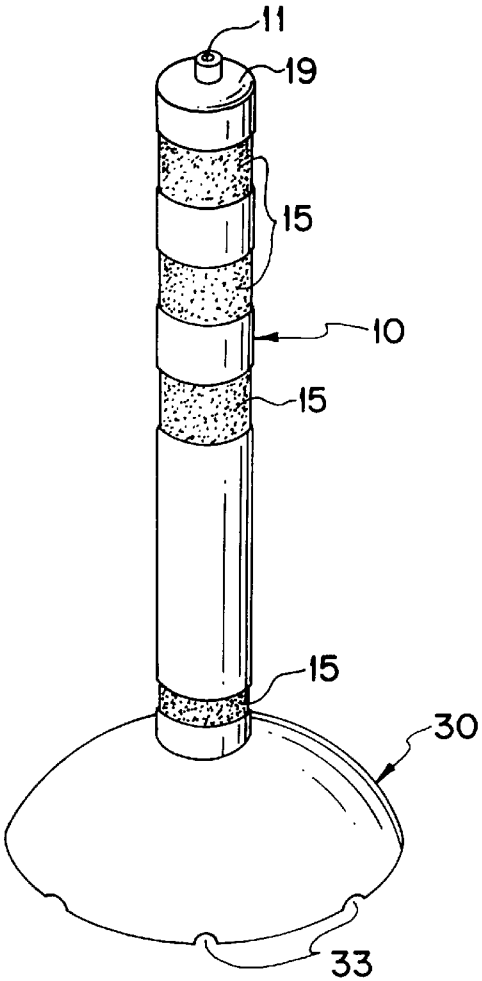
FIG. 1 is a perspective view of the surface adhesive mounted and self-recovering delineator of this invention.
Figure 3:
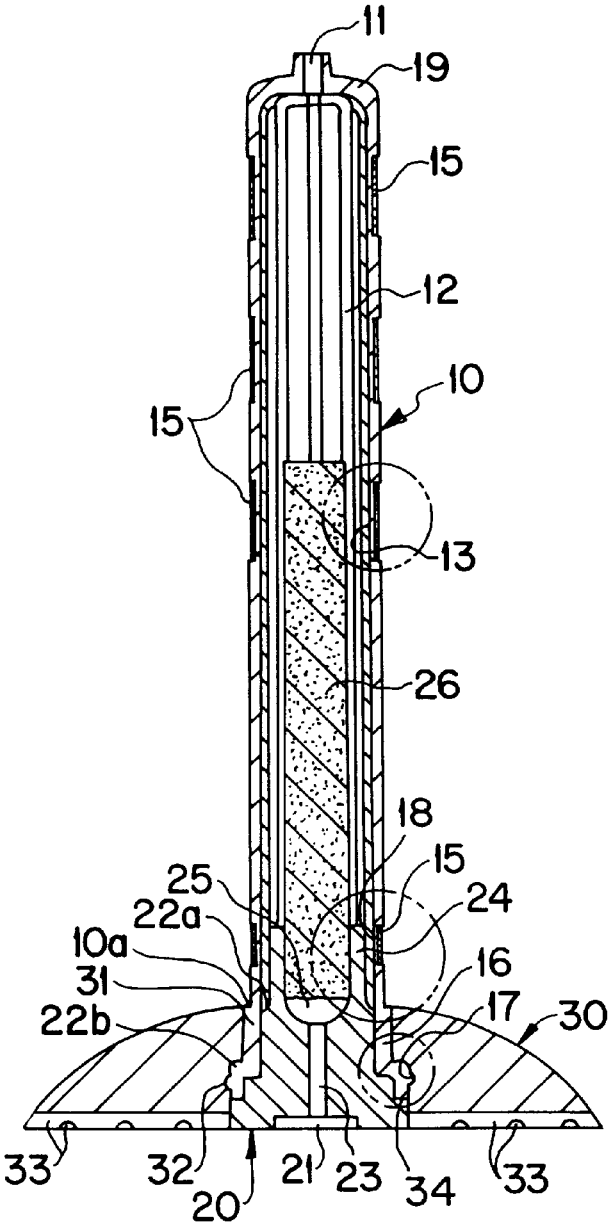
FIG. 3 is a vertical section view of the surface adhesive mounted and self-recovering delnieator of this invention and FIGS. 3A–3C are enlarged details of respective areas shown circled in FIG. 3.
Figure 3A:
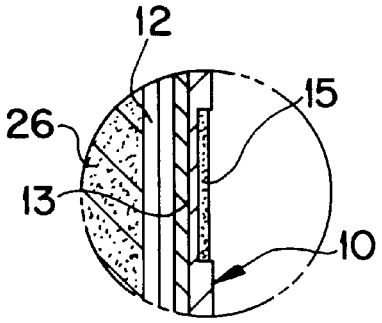
Figure 3B:
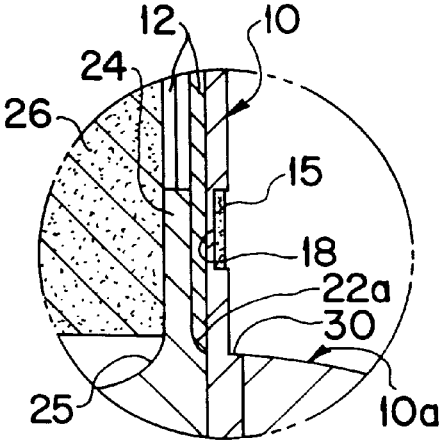
Figure 3C:
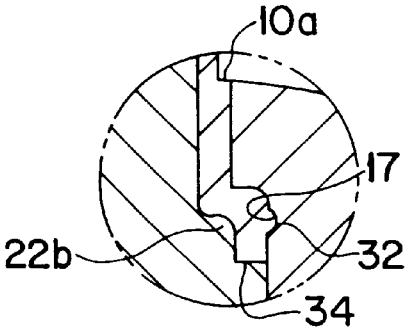
Figure 4:
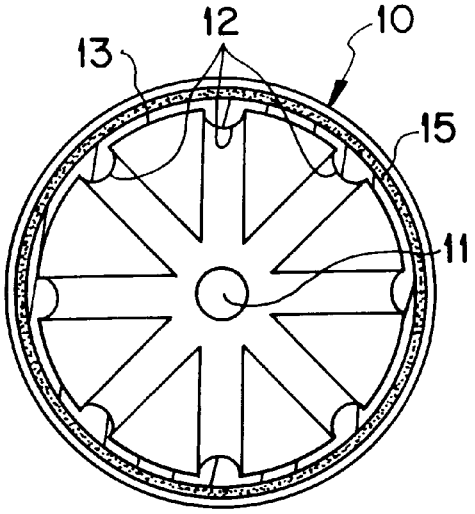
FIG. 4 is a cross-sectional view of the delineator on line 4—4 in FIG. 2.
Figure 5:
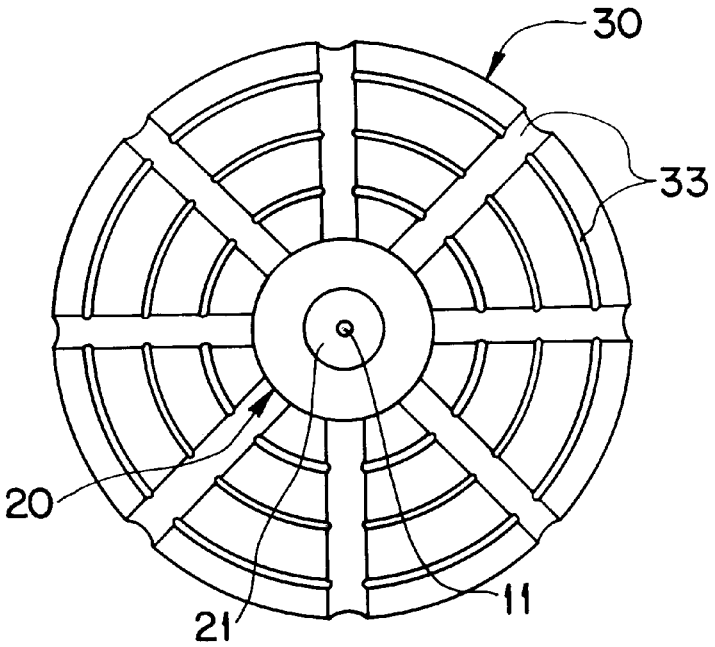
FIG. 5 is a bottom view of the surface adhesive mounted and self-recovering delineator of this invention.
Figure 6:
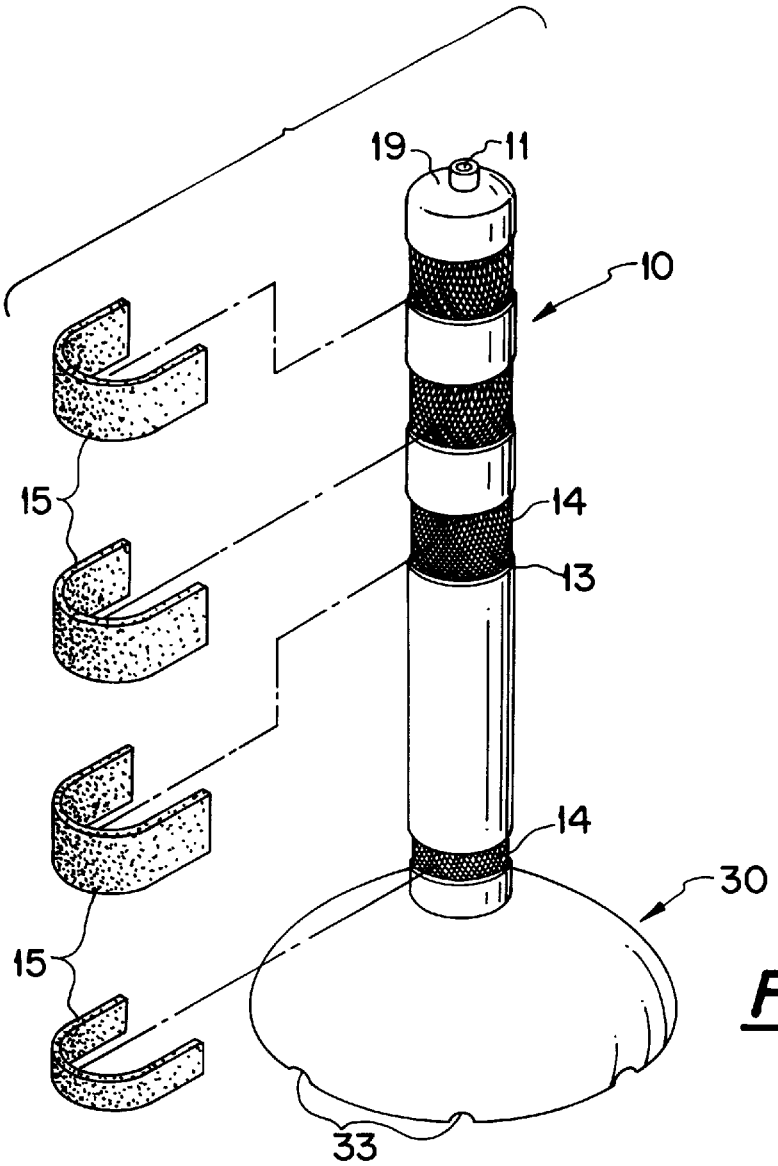
FIG. 6 is a exploded perspective view showing a reflection sheet separated from the surface adhesive mounted and self-recovering delineator of this invention.
Figure 7:
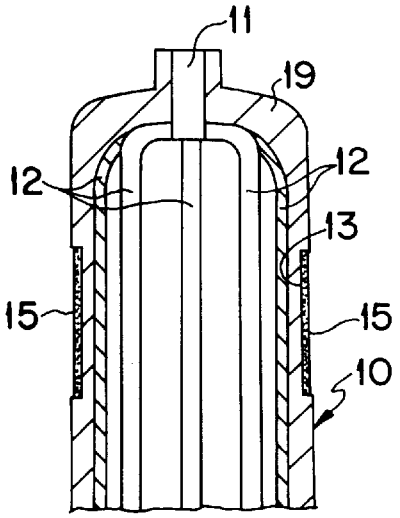
FIG. 7 is a sectional view showing the upper part of the surface adhesive mounted and self-recovering delineator of this invention.
Figure 8:
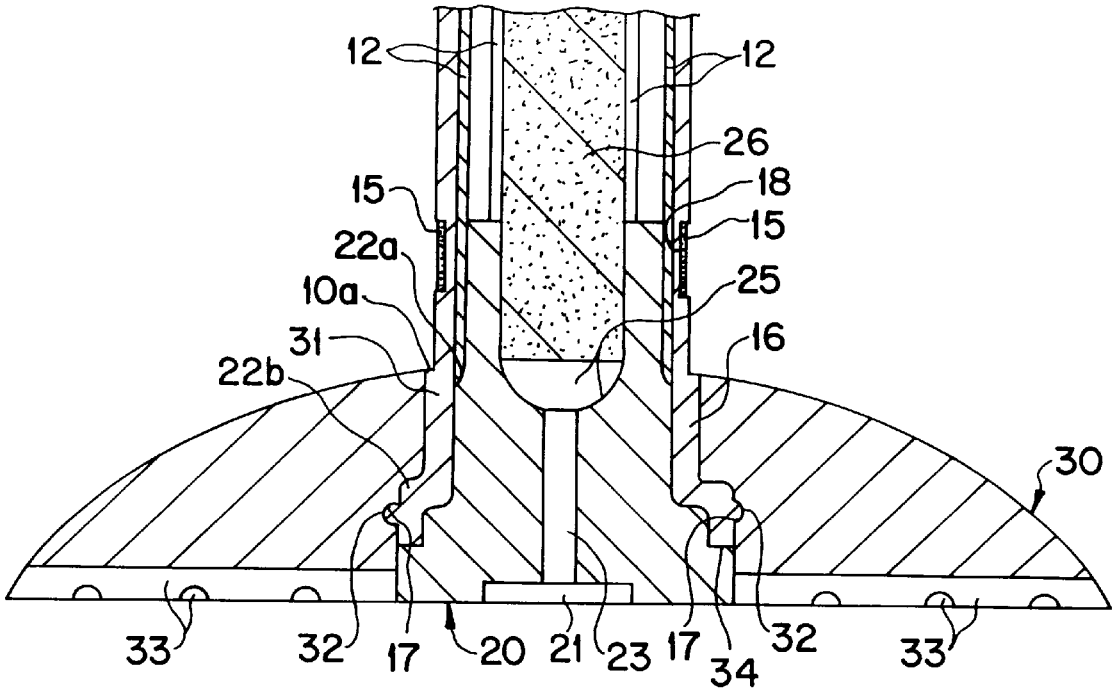
FIG. 8 is a sectional view showing the lower part of the surface adhesive mounted and self-recovering delineator of this invention.

As shown in the FIG. 1 through FIGS. 1–8, the post(10) is of cylinderical form, in the inner space of which the support rib(12) is projected upwardly, and on outer surface of which several grooves(13) are formed as of irregular surface(14) that provides the area for the reflection sheet(15) to be attached thereon.

The post(10) has the air outlet and inlet(11) at the center of its upper surface and the high elastic head part(19) obtained by rounding the encountering edge of the upper surface and side, wherein the upper surface is designed to have more thickness than that of the side for giving the high elasticity.

The lower part of the post(10) is provided with a joint part(16) having a stub and on the outer circular surface of post is provided a groove that is also usable for a signpost and that has an irregular surface on which the reflection sheet(15) is attached. The jointer port(16) is provided with a circular protrusion(17).

It is advisable to form the irregular surface(14) as knurling engraved with opposite angle grooves.

The supplementary support panel(20) is designed to form an anti-contraction space(21) at its bottom part that makes the anti-contraction and pressurized air outlet(23) is to form by passing through together with the central part of anti-contraction space(21) and the upper part of supplementary support panel(20).

A plurality of stubs(22*a*, 22*b*) are formed on the outer surface of the supplementary support panel(20), such that the outer diameter of the supplementary support panel(20) is gradually varied, and each stub is rounded at its corner and edge.

Figure 9:
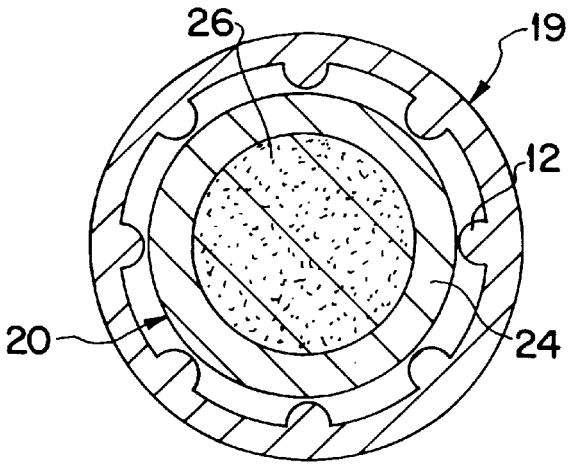
FIG. 9 is a cross-sectional view of the delineator line 9—9 in FIG. 2.

In the upper portion of the supplementary support panel (20), an impact absorption and guide(24) is formed, such that the outer circumferential surface thereof contacts the inner surface of the support rib(12) as shown in FIG. 9.

The inner lower surface of the guide(24), for impact absorption, is rounded so as to form an anti-contraction surface, and an impact absorption member(26) is inserted inside the guide(24).

The support panel(30) has in its center, an insertion hole(31) for the bottom part of post(10) having the supplementary support panel(20) to be inserted in, in which the circular stub(34) is provided on its lower part and a circular groove(32) is provided at the inner part of the insertion hole(31) for engaging with the circular protrusion(17).

The inner diameter of the insertion hole(31) is a little larger than the outer diameter of the post(10), but the inner diameter of the lower part of the post(10) is as same as the outer radius of insertion hole(31) to form the reflection sheet protection stub(10*a*).

Further, there are provided many pressurized air outlet grooves(33), opening in the bottom of support panel(30) at the radial direction and arranged in a concentric circle.

Any of post(10), support panel(30) and reflection sheet (15) are coated with diluted silicon mixed with tin origin organic material.

It is advisable to make post(10) and supplementary support panel(20) and support panel(30) using polyurethane having superior flexibility.

When the delineator is collided with by a vehicle or, as the result of such a collision, is trod upon by a vehicle, the inner air in the post(10) is quickly forced out through the air ourlet and inlet(11) and the post becomes squeezed so that no damage to the vehicle occurs. Upon the deviation of the vehicle from the place, the delineator is easily recovers its own shape owing to its self-recovery power.

At that time, the support rib(12) formed in perpendicular inside the post(10), the high elastic head(19) having more thickness than that of the side of post and the impact absorption member(26) may highlight the self-recovery power so that the deleneator can be quickly recovered to its original state, irrespective of collision strength. Thus, the use of delineator is guaranteed for a long time.

In addition to the rounding part of the stub(22*a*, 22*b*) corner of the supplementary support panel(20) protects the supplementary support panel(20) from being torn off, by decreasing the stress concentration, and further helps assembling work. And, owing to several grooves formed on the upper part of post(10) and the attached reflection sheet(15), the discrimination effect has to be increased. Furthermore reflection sheet(15) is attached on the groove(18) formed on lower part of post(10) and situated in alignment with the signpost installed on middle part of the road so that it helps drivers to recognize the traffic lane accurately, even in the dark.

Furthermore, the irregular surface(14) formed both on the groove(13) and the grooves(18), being so formed as to have an opposition angle, broadens the adhesive area, whereby strong ahhesion between the reflection sheet and the irregular surface is guaranteed and accordingly the occurrence of bubbles are also effectively prevented by making easier the outlet of pressurized air when adhering the reflection sheet (15).

On the other hand, since the support panel(30) is separated from the post(10) and supplemental support panel(20), package volume is minimized by which safeguarding and moving of the delineator is easy and accordingly the moving cost and safeguarding cost are also curtailed.

An anti-contraction space(21) at the bottom part of the supplementary support panel(20) and the anti-contraction surface(25) on the upper part of the support panel prevent the contraction of supplementary support panel(20) by forming anti-contraction and pressurized air outlet(23) when the supplementary panel is molded by injection.

When in case of installing the delineator on a road, it is required firstly to insert the impact absorption member(26) into the impact absorption and guide(24) at the bottom of post(10), and sencondly insert the supplementary support panel(20) having the impact absorption member(26) into the insertion hole(31) of support panel(30) by force.

At that time, the fact that impact absorption member(26) is inserted into the inside post(10) and the lower part of post(10) is caught on the stub(22*b*) and circular protrusion (17) is caught on by the circular groove(32) makes joining of the parts of the delineator to one another more strong.

When the post(10) and supplementary support panel(20) are joined to each other, the next step is to insert the post(10) into the insertion hole(31) of the support panel(30) by force, then the lower stub(34) of the post(10) is caught on the circular stub(34) of the support panel(30) and the the crcular protrusion(17) of the post(10) is strongly engaged with the circular groove(32) formed on inner surface of insertion hole(31) of support panel(30).

At the time, because the inner diameter of insertion hole(31) is a little larger than the outer diameter of the post(10), one is enabled to assemble the product easily. However, the lower part of the post(10) is as same as the diameter of inner diameter to form the reflection sheet protection stub(10*a*) so that when joining the post(10), the reflection sheet(15) is prevented from injury and its joint is strengthened.

When the joint work for post is completed as above described, the next step is to apply the adhesive on the ground, the supplementary support panel(20) and the support panel(30), and adhere the delineator basally on the ground for support.

At that time, bubbles from the adhesive are exhausted throughout anti-contraction and pressurized air outlet(23) formed in the anti-contraction space(21) of the supplementary support panel(20) and pressurized air outlet groove(33) so that adhesion power is kept for a long time and the delineator is strongly adhered.

On the other hand, the coating material coated on any of the post(10) and reflection sheet(15) and support panel(30) protects against adherence of dust, soil and various poison, keeping the reflection effect as it was when the delineator was new. Furthermore, because of the ultraviolet protection, no change of color occurs so that a maximum life span is guaranteed.

The delineator is made of flexible materials and self-recovers upon impact, thus the delineator is not harmful, and impact on an vehicle is minimized. In addition, owing to the small package volume, it makes not only possible to easily move and safeguard, but also provides the advantage to easily assembly and install on the ground, and thus to obtain the maximum economic effect and productivity.

In claim:

1. A self-recovering basally adhered traffic lane delineator for a roadway, comprising:

a hollow, vertically oriented cylindrical post having an upper end and a lower end, said lower end being open;

an opening centrally provided through said upper end of said post, for venting air to and from internally of said post to externally of said post;

a plurality of circumferentially spaced ribs provided internally on said post and extending longitudinally of said post;

an annular support panel;

said post, externally of said post near said lower end of said post, and said annular support panel radially inwardly of said annular support panel being provided with cooperatively interfitted groove and stub features by which said post is secured to said annular support panel, so as to extend upwardly from said annular support panel;

a supplementary support panel received in said lower end of said post, from below, and being radially surrounded by said post and by said annular support panel;

said annular support panel and said supplementary support panel having respective downwardly presented lower surfaces arranged to face a roadway surface on which the delineator is to be basally mounted;

said lower surface of said annular support panel being arranged to have an adhesive applied thereon for basally adhering the delineator to a roadway surface;

a vent opening formed axially through said supplementary support panel for communicating between said lower surface of said supplementary support panel and internally of said post;

an impact absorption member disposed within said post so as to be supportingly radially surrounded by said ribs and so as to be supported on said supplementary support panel;

at least one circumferential groove externally provided in said post at a respective level intermediate said upper and lower ends of said post, each said groove receiving a respective circumferentially extending strip of radially outwardly facing reflective material;

said post being made of elastic flexible material.

2. The delineator of claim 1, wherein:

said post, at said upper end thereof is thicker than is said post between said upper and lower ends, at least excluding said ribs, to provide a highly elastic head for said post.

3. The delineator of claim 1, wherein:

said downwardly presented lower surface of said annular support panel is provided with a set of downwardly opening radial grooves and a set of concentric annular grooves of graduated diameter; said set of downwardly opening radial grooves intersecting said set of concentric annular grooves.

* * * * *